United States Patent [19]

Brown et al.

[11] 4,374,577

[45] Feb. 22, 1983

[54] ADAPTER ASSEMBLY FOR FLAT TRAJECTORY FLIGHT

[75] Inventors: Michael A. Brown, Columbia; Chris A. Kalivretenos, Hyattsville, both of Md.

[73] Assignee: The United States of America as represented by the Secretary of the Navy, Washington, D.C.

[21] Appl. No.: 649,615

[22] Filed: Jan. 14, 1976

[51] Int. Cl.[3] ..... F41G 7/00

[52] U.S. Cl. ..... 244/3.21; 244/3.23; 244/3.1

[58] Field of Search ..... 244/3.16, 3.20, 3.21, 244/3.23, 3.1; 74/5.12, 5.41, 5.44; 46/50; 89/1.8

[56] References Cited

U.S. PATENT DOCUMENTS

| | | | |
|---|---|---|---|
| 2,822,755 | 2/1958 | Edwards et al. | 244/3.22 |
| 3,067,682 | 12/1962 | Feldmann et al. | 244/3.23 |
| 3,180,223 | 4/1965 | Rambacher et al. | 89/1.8 |
| 3,195,462 | 7/1965 | Petre | 244/3.1 X |
| 3,273,406 | 9/1966 | Epstein et al. | 74/5.12 |
| 3,540,679 | 11/1970 | McCullough | 244/3.22 |
| 3,869,101 | 3/1975 | Schnabele et al. | 244/3.1 |
| 3,945,146 | 3/1976 | Brown | 46/50 |
| 3,946,967 | 3/1976 | Rodgers | 244/3.20 |

*Primary Examiner*—Harold J. Tudor

*Attorney, Agent, or Firm*—R. S. Sciascia; A. L. Branning

[57] ABSTRACT

An aerodynamic lift-generating adapter assembly secures to the nose of an unguided projectile to provide a capability for flat-trajectory flight. The adapter assembly comprises a rotatably-supported, roll-stabilized lift-generating section coupled to an actuator section containing inertia means to initiate gyroscope rotor spinning. The control gyroscope is directly linked to the lift-generating device to maintain fixed orientation of the lift.

20 Claims, 6 Drawing Figures

ADAPTER ASSEMBLY FOR FLAT TRAJECTORY FLIGHT

BACKGROUND OF THE INVENTION

The present invention relates generally to aerodynamic control systems. More particularly it relates to an aerodynamic lift-generating assembly adaptable to unguided projectile to incorporate a capability for flat trajectory flight.

Requirements currently exist for an unguided projectile having a flat trajectory flight capability. For example, in military applications an anti-tank weapon system is a lightweight, hand-held weapon capable of launching an explosive-laden projectile directly at a vehicle target located at a moderate distance. Preferably, the projectile should possess good armor penetration capability and fly a flat trajectory. Existing weapon systems of this type employ low projectile launch velocities which result in lofted trajectories. This in turn requires the user to make time-consuming range estimates and subsequent launcher adjustments. Unfortunately, these launcher adjustments are inaccurate since it is very difficult to estimate range to better than 30 percent. Thus, this substantially reduces the first round hit probability of the system.

Flattening of the trajectory of a projectile fired from a hand-held launcher can be accomplished by increasing the launch velocity of the projectile and/or by employing projectile lift. There is, however, a limit on the permissible velocity increase because of the recoil factor. For example, if the desired vertical drop of a five-pound projectile at a target range of 250 meters is one foot, then the launch velocity would have to be increased to approximately 3300 ft./sec. This is far in excess of the capability of any existing or planned hand-held launching system. Therefore, until a far superior recoil and blast abatement system is conceived and built, the direct means of achieving a flat trajectory, namely, greatly increased initial velocity, will have to be held in abeyance.

Alternative methods of achieving a flat trajectory include providing the projectile with lift and lift combined with increased initial launch velocity, the latter permitting design tradeoffs between launch velocity and the size of the lifting surfaces required. These alternative methods, however, present their own set of problems. In the design of a lifting projectile, the lift force should be equal to the weight of the projectile, and means must be provided for orienting and maintaining the lift force in the vertical direction.

Lift can be generated easily by using wings, fins, body asymetries, jets, etc. Orientation of the lift vector, however, is a much more difficult problem. Because of manufacturing asymmetries of the stabilizer and of lifting surfaces, the projectiles will develop significant roll displacement in flight. The resulting roll rates can be large since the axial moment of inertia of these projectiles is extremely low, varying in the range of 0.0012 to 0.0025 slug-feet-squared. Controlling the roll of the lift vector, then, is a major problem in the design of lifting projectiles for flat-trajectory flight. In the interest of providing a lifting projectile that is simple and inexpensive, the more costly active roll control systems are not attractive in comparison to the simple, passive and semiactive types of roll control systems. Active control systems employ sensors to produce signals which regulate the control surfaces in response to motion outside of a predetermined, acceptable range. Passive control systems employ fixed-orientation control surfaces which are not self-correcting in response to a motion deviation, and semiactive systems incorporate into the control surfaces a predetermined amount of corrective control, usually via mechanical means.

Methods of controlling or minimizing the roll displacement of the projectile can be categorized as follows: (a) roll minimization, (b) roll resistance, (c) aerodynamic roll stabilization techniques, (d) attitude stabilization, (e) gravity orientation, (f) gyro-orientation, and (g) ballutes and streamers. Each of these methods possesses limitations when applied to roll control of a lifting projectile launched from a hand-held weapon system, such as inadequate or improper roll control, complexity, too expensive, or introduction of other aerodynamic control problems. The prior art is replete with projectiles which apparently possess flat-trajectory capabilities and attempt to obviate one or more of the foregoing problems. For example Detalle, in U.S. Pat. No. 3,752,425, describes a missile having a pair of extended lifting airfoils with a gyroscope acting as a banking stabilizer to maintain a substantially constant attitude for the airfoils. One problems with Detalle's missile is the roll instability introduced by the rigidly-fixed lifting airfoils. In a copending application by C. Kalivretenos and M. Brown entitled "Flat Trajectory Projectile," the foregoing problems are solved in an unguided projectile having a roll-stabilized lifting device which is rotatably supported on the projectile.

There exists in the military inventory a large quantity of unguided projectiles for use with hand-held, tube launcher weapon systems. Since the shelf life of the projectiles is approximately ten years, they are not likely to be discarded soon, and the incorporation of a flat-trajectory capability into these projectiles will greatly enhance their performance and effectiveness. The existing means of achieving a flat-trajectory capability cannot be employed since they are designed to be incorporated into newly-fabricated missiles and projectiles, not to existing, already-fabricated ones.

The invention described herein provides an efficient, effective, economical and simple means of adapting an aerodynamic lift-generating device to existing unguided projectiles to provide them with the capability for substantially flat-trajectory flight. Adaption of the lifting devices require no modifications to the projectiles, and impart no deleterious effects thereto.

SUMMARY OF THE INVENTION

Accordingly, it is an object of the present invention to provide an aerodynamic lift-generating device adaptable to existing projectiles.

Another object of the invention is to provide a lift-generating device adaptable to existing projectiles that is effective, economical and simple to install, without requiring modifications of the projectile.

Another object of the invention is to provide a lift-generating device adaptable to existing projectiles to provide the capability of substantially flat-trajectory flight.

Yet another object of the invention is to provide a roll-stabilized lift-generating device adaptable to existing projectiles to provide a flat-trajectory flight capability.

Still another object of the invention is to provide a gyroscopically-stabilized, lift-generating device adaptable to existing projectiles to provide a flat-trajectory flight capability.

A further object of the invention is to provide a gyroscopically-stabilized, lift-generating device adaptable to existing projectiles for flat-trajectory flight which permits uncoupled rotation of the projectile.

A still further object of the invention is to provide a roll-stabilized, lift-generating device adaptable to existing projectile having self-contained, inertia-responsive means to initiate stabilizing gyroscope operation.

Yet a further object of the invention is to provide a roll-stabilized, lift-generating device adaptable to existing projectiles having unique gyroscopic caging and rotation-preventing means.

These and other objects of the invention are attained in a gyroscopically-stabilized, aerodynamic lift-generating assembly attachable to the nose of an unguided projectile. A lifting nose-tip is directly linked to a displacement-type gyroscope, which in turn is rotatably connected to an actuator section attachable to the projectile. Inertia means within the actuator section is operatively connected to the gyroscope rotor to initiate spinning thereof. A spring-biased plunger cooperates with the actuator section to orient the lifting nosetip and to cage the gyroscope. Subsequent to projectile launch a spatial gap is effected between the lift-producing section and the actuator section to permit free rotation of the projectile relative to the roll-stabilized, lift-generating section.

BRIEF DESCRIPTION OF THE DRAWINGS

A more complete understanding of the invention and a fuller appreciation of the many attendant advantages thereof will be derived by reference to the following detailed description when considered in connection with the accompanying drawings, wherein.

DESCRIPTION OF THE PREFERRED EMBODIMENT

Figure 1:
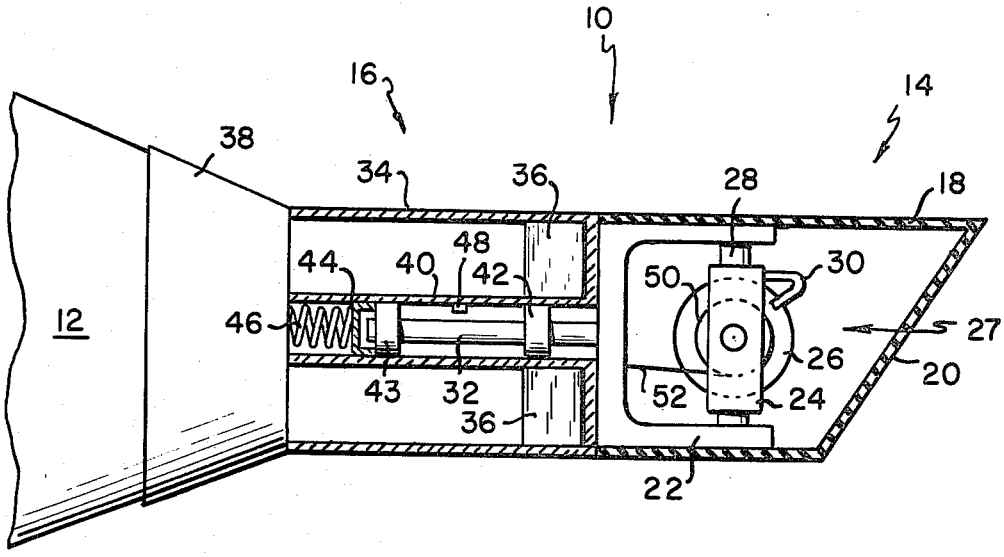
FIG. 1 is a sectioned, elevational view of the present invention.

Referring now to the drawings wherein like reference characters designate identical or corresponding parts throughout the several views, there is shown in FIG. 1 the aerodynamic lift-generating adapter assembly 10 of the present invention attached to the nose of an unguided projectile 12. The lift-generating assembly comprises a forward, roll-stabilized, lifting nosetip section 14 and the actuator section 16 which couples the lifting nosetip section to the forward extremity of the projectile and houses the gyroscope activation mechanism.

The lifting nosetip section 14 includes a hollow cylindrical, aerodynamically-shaped nosetip 18 having a slanted, forward surface 20 inclined at the proper angle such that the lift produced by the assembly 10 is sufficient to cause the entire projectile 12 to fly at a small angle of attack, which in turn produces a lifting force on the projectile sufficient to counter the effect of gravity. Within the nosetip 18, adjacent to the open, aft end thereof, is a U-shaped bracket 22 which pivotally supports the inner gimbal 24 and rotor 26 of a displacement-type gyroscope 27. Gimbal 24 is attached to pivot pins 28, the free ends of which are received in bores provided in the bracket 22. Friction-reduction means may be incorporated with the pivot pins 28 if friction is a problem, such as sleeve inserts of plastic or other suitable material. The rotor 26 is rotatably supported on the inner gimbal 24 by any suitable means, and is oriented orthogonally to the pivot axis of the gimbal, as is known in the art. A shear element 30 is attached to the gimbal 24 and extends into a hole in the rotor to immobilize the rotor after it is "wound" during assembly of the lift-generating adapter, as will be described more fully below.

Coupled to the lifting nosetip section 14 by means of a longitudinal shaft 32 is an actuator section 16, including a hollow, cylindrical housing 34, closed at the end adjacent to the lifting nosetip section, and slidably receiving therein a weight 36. The aft end of the actuator section 16 is fixedly attached directly to the nose of the projectile 12, as with a suitable adhesive. Alternatively, as shown in FIG. 1, the aft end of the housing 34 may be securely attached to an adapter fairing 38, which is properly shaped to fit over the nose portion of the projectile 12, and the fairing appropriately attached to the nose portion.

Extending along the longitudinal axis of the actuator housing 34 and concentric therewith is a cylinder 40 of a smaller diameter than the housing, open at both ends. The weight 36 is provided with a central bore of sufficient size to circumscribe the cylinder 40 to permit the weight to slide within the housing along the cylinder. The longitudinal shaft 32, with one end securely attached to the bracket 32, as by screw threads, extends into the cylinder 40 and is rotatably and slidably supported within the cylinder by a pair of bearings 42 and 43 securely fixed thereon intermediate the ends thereof. Thus the shaft 32 and the lifting nosetip section 14 attached to the shaft are able to slide longitudinally and to rotate relative to the actuator section 16, and hence also the projectile 12 due to the secure attachment of the actuator section to the projectile.

The end of the longitudinal shaft 32 extending into the cylinder 40 is adjacent to a circular cap 44, positioned longitudinally so that the end of the shaft is received within the central recess of the cap and the extending rim of the cap 44 abuts the surface of the bearing 43 positioned adjacent the end of shaft 32. A helical spring 46 is placed within the cylinder 40, with one end thereof in abutment against the flat surface of the cap 44. A stop 48, such as a protrusion, extends radially inward from the inner surface of the cylinder 40 and is so located to interfer with the longitudinal movement of the bearing 43 to prevent complete withdrawal of the shaft 32 from the cylinder 40.

Figure 2:
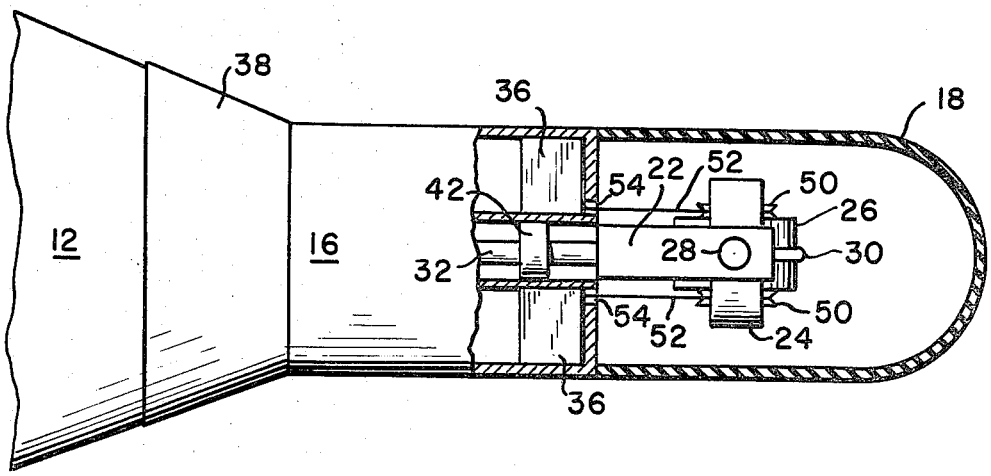
FIG. 2 is a sectioned, top view of the present invention.

More clearly visible in FIG. 2, a view looking "down" on the assembly 10 of FIG. 1, is the inertia means employed to initiate spinning of the gyroscope rotor 26. The rotor, which may be a circular disc of appropriate material, has on each lateral surface thereof a grooved, pulley-like extension 50, positioned collinearly with the rotational axis of the rotor 26 and rotating therewith as a unit. Rotor extensions 50 may be separate pulley structures fixedly attached to the rotor 26, or may be machined from the same, single piece of material from which the rotor is fabricated. One end of a cord 52 is wound around each of the rotor extensions, the cord extending back into the actuator section 16 through an opening 54 in the end wall 56 of the housing 34 to be attached at the other end to the slidable weight 36.

Figure 3:
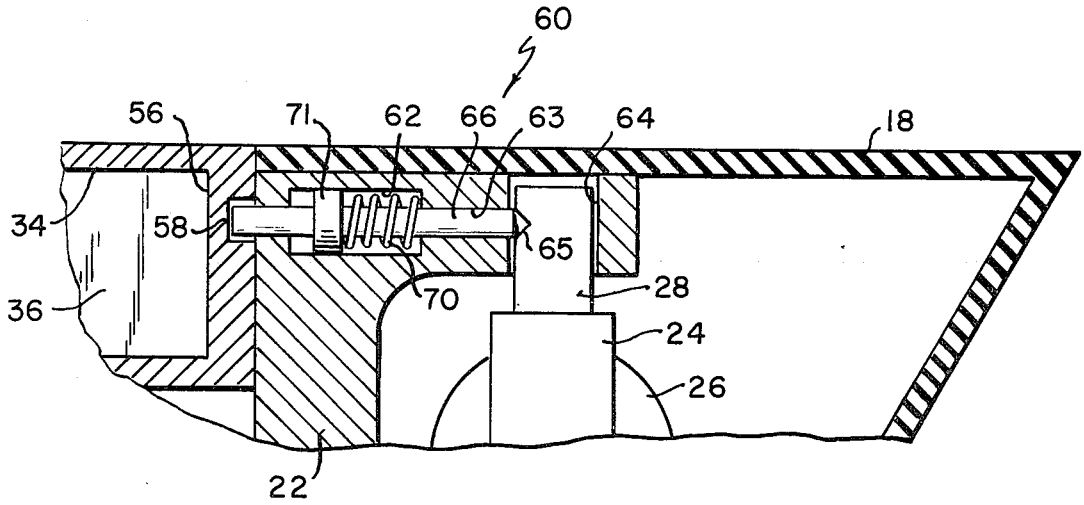
FIG. 3 is an enlarged, partial view of FIG. 1 showing details of the rotation preventing mechanism incorporated into the present invention.
Figure 4:
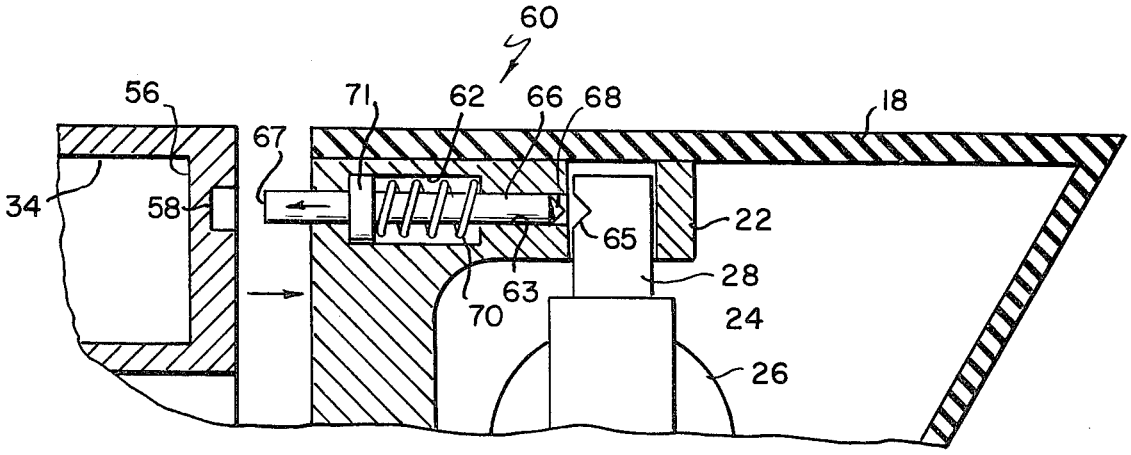
FIG. 4 is a view similar to FIG. 3, but with the projectile in flight.

Shown to an enlarged scale in FIGS. 3 and 4 are sectioned views of the interface region of the lifting nosetip section 14 and the actuator section 16. Details are visible of the spring-biased plunger assembly 60 for orienting the nosetip 18 relative to the actuator housing 34 and for caging the inner gimbal 24. Within the "upper" branch of the U-shaped bracket 22 and adjacent to the aft surface thereof is a chamber 62. A coaxial, smaller-diameter, longitudinal bore 63 connects the forward end of the chamber 62 with the transverse bore 64 receiving the inner gimbal pivot pin 28. The pivot pin 28 has a conical recess 65 which aligns with the longitudinal bore 63. Received within the chamber 62 and the bore 63 is an elongated plunger pin 66 having a blunt end 67 which extends aft of the bracket 22 and a pointed end 68 which extends into the conical recess 65. A helical spring 70 abuts a collar 71 adjacent the blunt end 67 of the pin 66 and the end of the chamber 62 to bias the blunt end of the pin 66 out from the aft surface of the bracket 22; collaterally, the spring urges the pointed end 68 of the pin out from the recess 65. The end wall 56 of the actuator housing 34 has a circular recess 58 to receive the blunt end of the pin 66 when the adapter assembly 10 of the present invention is in the assembled condition of FIG. 3, the recess 58 being spaced 90 degrees from the openings 54 through the cords 52 extend. When the gyroscope rotor 26 is rotated to wind the cords 52 around the pulley extensions 50, the nosetip section 14 and the adapter section 16 are drawn together, compressing the spring 46 (FIG. 1). The blunt end 67 of the plunger pin 66 is received within the recess 58, and the abutment of the end wall 56 and the bracket 22 forces the pointed end 68 of the plunger pin to engage the conical recess 65, with the helical spring 70 being compressed by the collar 71. Thusly assembled, the lifting nosetip 18 is properly oriented with respect to the adapter section 16 by the engagement of the recess 58 and the blunt end 67 of the pin 66, and the inner gimbal 24 of the gyroscope is caged by the engagement of the pointed end 68 with the conical recess 65 in the gimbal pivot 28. After projectile launch the lifting section 14 separates from the adapter housing 34 under the force of the spring 46 (note arrows in FIG. 4), as further explained hereinbelow, the helical spring 70 extracts the pointed end 68 of the plunger pin 66 from the conical recess 65 to permit free rotation of the gimbal 24. The disengagement of the pin 66 from the recess 58 permits the free rotation of the projectile 12 and the attached adapter section 16, with the rotational attitude of the lifting nosetip section 14 being maintained by the gyroscope 27.

Figure 5:
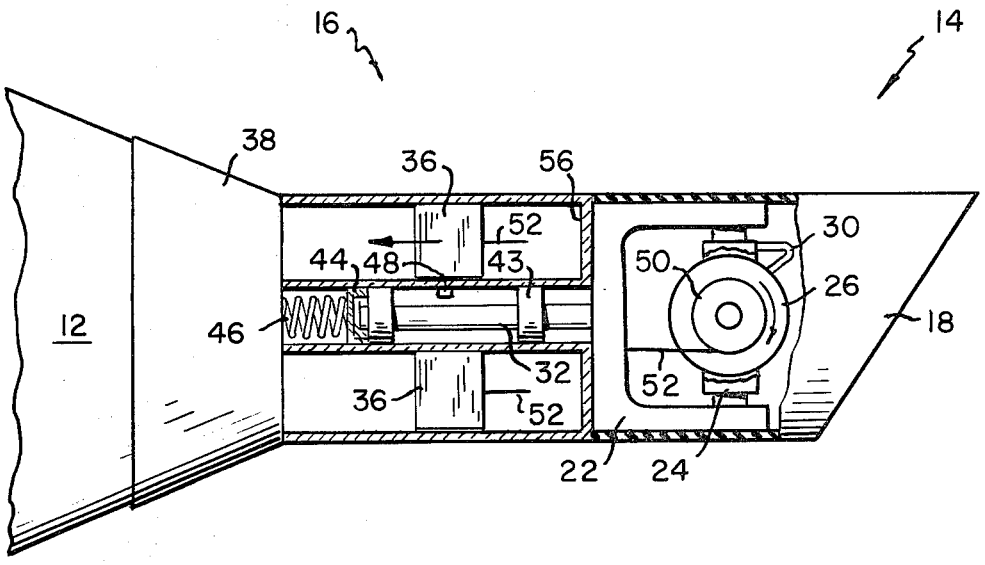
FIG. 5 illustrates operation of the invention shortly after projectile launch.
Figure 6:
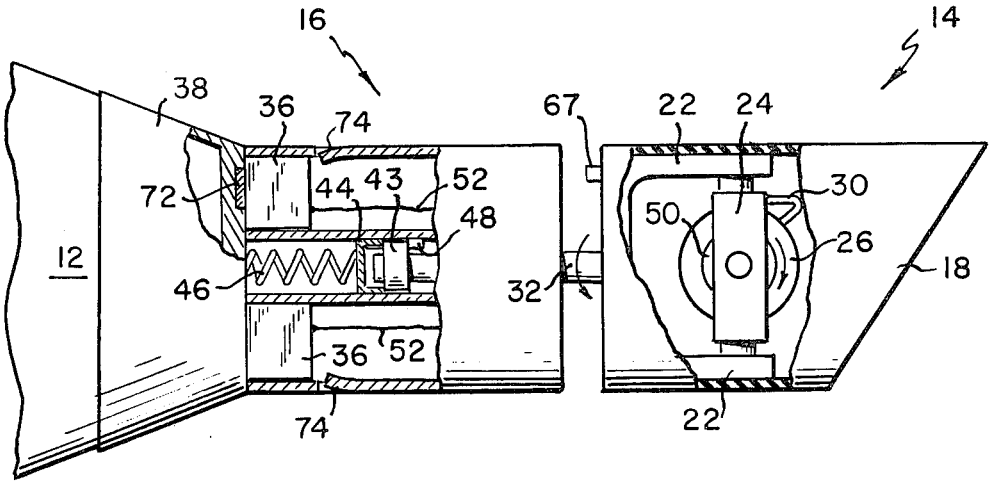
FIG. 6 shows the relative position of the invention after projectile launch and during flight.

The functioning of the present invention can be more clearly seen by reference to FIGS. 5 and 6 of the drawings. FIGS. 1 and 2 show the ready condition of the aerodynamic lift-generating adapter assembly 10 as attached to the nose of the unguided projectile 12. In this condition the nosetip section 14 and the adapter section 16 have been drawn together by the winding of the cords 52 about the pulley extensions 50 on the rotor 26. The slidable weight 36 abuts the end wall 56 of the adapter housing 34, with the plunger pin 66 engaging the recesses 58 and 65, as described hereinabove. Spring 46 is compressed by the longitudinal shaft 32, and the shear element 30 engages the rotor 26 to immobilize it. The projectile 12 is then loaded into a suitable launcher and subsequently launched. Under the resultant force of acceleration the weight 36 begins to slide backwards, towards the projectile nose, drawing on the cords 52 to sever the shear element 30 and to initiate rotor spinning. The acceleration force is of sufficient magnitude to maintain the nose section 14 and the adapter housing 34 in abutment and to hold the spring 46 compressed (FIG. 5). At this point the helical spring 70 of the plunger assembly 60 is still compressed, and both the nosetip 18 and the inner gimbal are still rotationally locked (FIG. 3).

After the projectile has been launched, and the acceleration force has diminished, the weight 36 has broken the cords 52 and now abuts the nose of the projectile 12 (left side of FIG. 6). The force of the spring 46 now exceeds the acceleration force and urges the shaft 32 forwardly, until the bearing 43 abuts the stop 48 to preclude further movement of the shaft and the lifting nosetip section 14 attached thereto. The spring force ensures continued separation of the nosetip section 14 and the adapter housing 34.

With the separation of the nosetip and the adapter housing, the blunt end of the plunger pin 66 is withdrawn from the recess 58, thus permitting the helical spring 70 to urge the plunger pin from the conical recess 65. By this time the rotor 26 is fully spinning and the gyroscope 27 is completely operational, with the inner gimbal 24 freely rotatable. The support bracket 22 and the attached lifting nosetip 18 functions as the outer gimbal of the gyroscope, this in turn being stabilized in roll to vertically maintain the lift vector. The bearing-supported longitudinal shaft 32 and the disengagement of the plunger pin 66 permits the projectile with the attached adapter section 16 to freely rotate relative to the roll-stabilized lifting nosetip section 14. The stabilized nosetip 18 will maintain its initial roll orientation of space regardless of the projectiles movements in pitch, yaw or roll. Any torque applied to the nosetip 18 is resisted by the gyroscope 27, which permits the inner gimbal to precess (rotate) with respect to the support bracket 22. This resistance continues until the inner gimbal and the bracket are aligned, an occurrence that is unlikely before projectile impact with its target.

Two alternative means are shown in FIG. 6 to hold the weight 36 against the projectile nose to obviate any objectionable, extraneous movements thereof. A magnetized element 72, such as a ring secured to an annular groove in the adapter fairing 38 (or to a groove in the projectile nose if a fairing is not used), draws and holds the weight after the cords 52 have been broken. Alternatively, the adapter housing 34 may be diametrically punctured at the appropriate location to produce two, inwardly extending tabs 74 which will abut the forward surface of the weight 36 to preclude any further movement thereof. The tabs 74 are sufficiently resilient so that they, in combination with their inward, aft angular orientation, will permit the weight to slide backward against the projectile nose with minimum of resistance, but will prevent forward motion of the weight. Of course only one such tab 74 need be utilized if this is sufficient.

By way of illustrative example only, the lifting nosetip 18 may be a cylindrical element having an integral, slanted forward surface 20 and an open aft end portion, and be molded of suitable plastic. This configuration facilitates economical production and minimizes weight. Similarly, the cylindrical adapter housing 32 may be molded of plastic, with the inner cylinder 40, the end wall 56 and the cord openings 54 integrally formed therewith. The aft end of the housing 34 is left open for insertion of the weight 36, a doughnut-shaped mass of brass or lead. The other components are fabricated of suitable material, such as aluminum for the bracket 22 and the longitudinal shaft 32, and brass or lead for the rotor 26.

The weight 36 is placed into the housing 34 with the ends of cords 52 passing through the openings 54. Longitudinal shaft 32 with the bearings 42 and 43 mounted thereon, is attached to the support bracket 22, the plunger assembly 60 and the gyroscope 27 already assembled thereto, and is then inserted into the cylinder 40, with appropriate provisions being made for passage of the bearing 43 beyond the stop 48, such as rotationally misaligned notch on the bearing housing surface. The free ends of the cords are wound upon the pulley extensions 50, drawing the gyroscope 27 and the actuator section 16 in the process. Engagement of the exposed end 67 of the plunger pin 66 with the recess 58 ensures correct alignment of the lifting nosetip section 14. Shear element 30 is inserted into the rotor 26 to prevent unwinding of the cords 52 and to hold the assembly 10 in abutment. The lifting nosetip 18 is placed upon and suitable attached to the bracket 22, as with adhesive or screws. Bearing cap 44 and spring 46 are then inserted into the cylinder 40, adjacent to the bearing 43 to complete assembly of the lift-generating adapter assembly 10. Attachment of the adapter assembly 10, as with a suitable adhesive, to the adapter fairing 38 and the attachment of the fairing to the projectile nose completes the modification procedure to provide the unguided projectile 12 with a flat-trajectory flight capability. If the adapter 38 is not used, then the assembly 10 is attached directly to the projectile nose.

Obviously, numerous modifications and variations of the present invention are possible in the light of the above teachings. It is therefore to be understood that within the scope of the appended claims the invention may be practiced otherwise than as specifically described herein.

What is claimed as new and desired to be secured by Letters Patent of the United States is:

1. An adapter assembly attachable to the nose portion of an unguided projectile to provide the projectile with a substantially flat-trajectory flight capability comprising:

an aerodynamic lift-generating section including both a lift-producing device and a separate stabilizing mechanism directly coupled to said device;

a separate and distinct actuator housing attachable to the nose portion of a projectile;

means for rotationally coupling said lift-generating section to said actuator housing; and inertia means within said actuator housing to initiate operation of said stabilizing mechanism, said adapter assembly producing a stabilized, vertically-oriented lift to counter the projectile weight.

2. The adapter assembly of claim 1 wherein said stabilizing mechanism comprises a gyroscope.

3. The adapter assembly of claim 2 further comprising a support bracket directly coupling said gyroscope to said lift-producing device.

4. The adapter assembly of claim 3 wherein said rotational coupling means comprises a longitudinal shaft attached to said bracket and rotationally and longitudinally supported by said actuator housing to permit free rotation of said lift-generating section relative to said actuator housing.

5. The adapter assembly of claim 4 wherein said inertia means comprise:

a mass slidably positioned within said actuator housing; and flexible connecting means joining said mass to the rotor of said gyroscope, whereby said mass responds to acceleration forces to exert a pull on said flexible connecting means to initiate spinning of the rotor.

6. The adapter assembly of claim 4 further comprising:

a cylinder within said actuator housing to receive said longitudinal shaft, said shaft longitudinally movable within said cylinder;

bearings on said shaft to permit free rotation of said shaft within said cylinder; and stop means in said cylinder to prevent complete withdrawal of said shaft from said cylinder.

7. The adapter assembly of claim 6 further including a spring within said cylinder coacting with said shaft to bias the shaft outwardly from said cylinder to the limit determined by said stop means.

8. The adapter assembly of claim 5 wherein said flexible connecting means are wound upon pulley extensions on the rotor of said gyroscope, the winding of said connecting means drawing said actuator housing and said lift-generating section into abutment.

9. The adapter assembly of claim 8 further comprising a plunger apparatus coacting with said actuator housing to prevent rotation of said lift-generating section and to cage said gyroscope.

10. The adapter assembly of claim 9 wherein said plunger apparatus comprises:

an elongated pin slidably received within a longitudinal chamber in said bracket, one end of said pin coacting with said gyroscope to prevent rotation of the gimbal and the opposite end extensible from an aft surface of said bracket; and a plunger spring biasing said pin toward an aft surface of said bracket, said pin being pressed into cooperative engagement with said gyroscope to prevent gimbal rotation when said lift-generating section and said actuator housing are in abutting relationship.

11. The adapter assembly of claim 10 further comprising a recess on a forward surface of said adapter housing to receive the extending end of said elongated pin.

12. The adapter assembly of claim 7 wherein said inertia means comprise:

a mass slidably positioned within said actuator housing; and flexible connecting means joining said mass to the rotor of said gyroscope, the connecting means being removably wound around pulley extensions on the rotor, whereby said mass responds to acceleration forces to remove said connecting means from the rotor to initiate spinning of the rotor.

13. The adapter assembly of claim 5 wherein said lift-producing device comprises a cylindrical member having a slanted forward surface.

14. The adapter assembly of claim 13 further comprising a fairing structure for attaching said actuator housing to the nose portion of a projectile.

15. An aerodynamic lift-generating mechanism attachable to the forward portion of a projectile comprising:

a gyroscopically roll-stabilized lifting section to produce a vertically-fixed lift vector including therein both a lift producing means and a stabilizing gyroscope;

a separate and distinct actuator housing attachable to the projectile;

a shaft attached at one end to said lifting section, the other end of said shaft being rotatably and rectilinearly receivable within said actuator housing to join said lifting section to said housing;

resilient means within said housing cooperating with said shaft to bias the shaft outwardly of said housing and towards said lifting section; and slidable inertia means within said housing coupled to the rotor of said stabilizing gyroscope with flexible connecting means for initiating spinning of the gyroscope rotor;

means for releasably drawing into abutment said lifting section and said actuator housing prior to launch of said projectile, whereupon launch of the projectile said lifting section and said actuator housing are released from abutment, said inertia means initiates operation of the gyroscope and said resilient means effects a spatial separation between said lifting section and said actuator housing to permit free rotation of the projectile relative to the roll-stabilized lifting section.

16. The mechanism of claim 15 whereupon said resilient means comprises a spring adjacent the free end of said shaft, said spring being compressed when the lifting section and the actuator housing are in abutting relationship.

17. The mechanism of claim 16 further comprising locking means to rotationally position the lifting section relative to the housing and to cage the stabilizing gyroscope.

18. The mechanism of claim 17 wherein said locking means comprises:

a rod slidably positioned within said lifting section, the rod having a blunt end extendable from said lifting section and a pointed end coacting with the stabilizing gyroscope to prevent rotation of the gyroscope gimbal;

a rod spring biasing the blunt end of said rod externally of said lifting section; and a receiving recess on a forward aft surface of said actuator housing collinearly positionable with the blunt end of said rod, whereby when said lifting section and said actuator housing are in abutting relationship the blunt end of said rod engages said recess to angularly position said lifting section and said housing, and the pointed end of said rod engages the gyroscope gimbal to prevent rotation of the gimbal.

19. The mechanism of claim 18 wherein said inertia means comprises a mass slidably positioned within said actuator housing.

20. The mechanism of claim 19 wherein said flexible connecting means comprises a pair of cords, one end of each of said cords secured to said mass and the other end of each of said cords being removably wound about the gyroscope rotor, the winding of said cords about the rotor drawing into abutment said lifting section and said actuator housing.

* * * * *